United States Patent [19]

Lutzenberger et al.

[11] 4,180,712

[45] Dec. 25, 1979

[54] SLIDE SWITCH

[75] Inventors: Kurt Lutzenberger, Arlington Heights; James R. Bailey, Chicago; James M. Hybl, Riverside, all of Ill.

[73] Assignee: Switchcraft, Inc., Chicago, Ill.

[21] Appl. No.: 924,278

[22] Filed: Jul. 13, 1978

[51] Int. Cl.[2] ..... H01H 15/02

[52] U.S. Cl. ..... 200/16 D; 200/16 R; 200/16 F; 200/291; 200/303

[58] Field of Search ..... 200/16 R, 16 C, 16 D, 200/16 F, 291, 303

[56] References Cited

U.S. PATENT DOCUMENTS

| | | | |
|---|---|---|---|
| 3,174,002 | 3/1965 | Golbeck | 200/16 D |
| 3,502,825 | 3/1970 | Bailey et al. | 200/16 |
| 3,592,983 | 7/1971 | Kroll et al. | 200/16 D |
| 3,912,887 | 10/1975 | Gratz et al. | 200/16 D |
| 3,947,391 | 3/1976 | Lutzenberger | 200/16 D |
| 3,983,341 | 9/1976 | Stanish | 200/303 X |
| 4,016,378 | 4/1977 | Arthur | 200/16 D |
| 4,016,401 | 4/1977 | Delaage | 200/16 C X |
| 4,075,442 | 2/1978 | Fukuda et al. | 200/16 F |
| 4,132,874 | 1/1979 | Bruni | 200/303 X |

FOREIGN PATENT DOCUMENTS

| | | | |
|---|---|---|---|
| 884009 | 7/1943 | France | 200/291 |
| 4913168 | 4/1974 | Japan | 200/16 F |

*Primary Examiner*—James R. Scott

*Attorney, Agent, or Firm*—Harold A. Murphy; Joseph D. Pannone; John T. Meaney

[57] ABSTRACT

An improved electrical slide switch having a housing portion, a slidable actuator within the housing, and a resiliently engageable and removable cap which may itself be the actuator, the actuator having a pair of precisely spaced integral leaflike elements which form a trackway of predetermined length which slide over an integral centrally disposed fixed pin carried by the base, with the pin being adapted to repose at opposite ends of the trackway when terminals within the housing are properly engaged with selected slider elements carried by the actuator.

3 Claims, 8 Drawing Figures

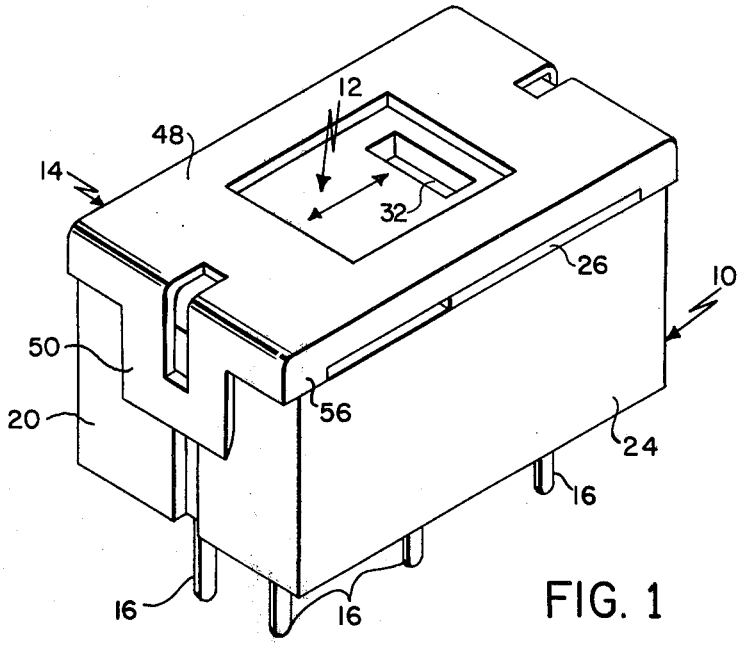
FIG. 1
FIG. 2
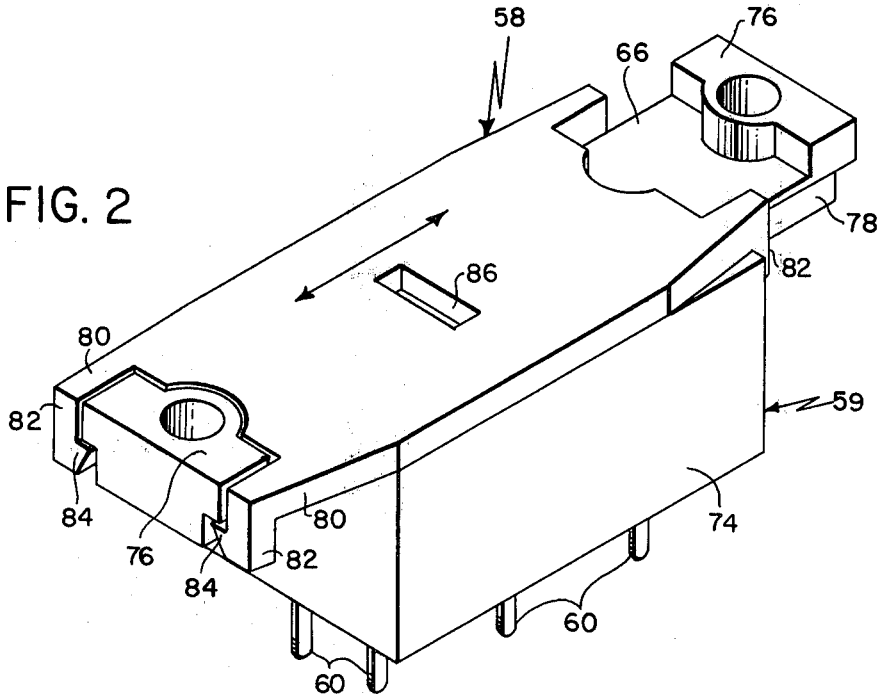

SLIDE SWITCH

BACKGROUND OF THE INVENTION

Electrical slide switches are well known in the art. In such switches slider elements which are connected to an actuator establish contact between selected terminals that are individually mounted in a terminal board which may be the base or bottom of the switch structure.

In switches of this type the actuators must be retained for sliding movement within the switch housing. This is usually achieved by a cap which is mounted over the top of the switch housing with means being provided through the cap for easy manual manipulation of the actuator. The cap may be suitably removably secured to the housing. However, in some conventional prior art switches the casing is a boxlike structure provided with a number of resilient detent bars in its opposed side surfaces for engagement with selected recesses in sides of the switch base member. In such cases the detent member is movable with the casing so that contact with selected terminals is achieved by engagement of the detents with selected recesses.

Obviously, such a conventional structure has drawbacks. For example, a casing might be accidentally disengaged from a base when a detent is located between recesses. Recesses may accumulate collections of foreign matter and thus prevent positive action of the detent mechanism.

In another conventional switch structure a separate metal cap is attached to the base by downturned side walls having inwardly bent tabs underlying the base. This structure is not easily disassembled.

In still another prior art structure side walls on the cap are provided with divergently angled tabs which are adapted to interlock with portions of side walls on the base. This structure requires a special assembling operation to bend the tabs into interlocking engagement with the base and is not easily disengageable.

The prior art teaches several other detent means for insuring selected engagement of the switch slider with the switch terminals, all of which appear to be relatively intricate or complicated or inefficient in operation, as exemplified by the first conventional switch discussed above. Others utilize separate metal springs or pluralities of pins and slots for the purpose.

SUMMARY OF THE INVENTION

The present invention overcomes the above and other problems associated with electrical slide switches by the provision of novel and efficient means for removably mounting a cap or actuator upon the casing and by the further provision of novel and efficient detent means built integrally into the housing and cooperative with a trackway built integrally into the actuator.

More specifically, the cap or actuator has downturned end portions shaped to interlock within recesses in the respective end walls of the casing. The cap or actuator is of a resilient material such as nylon and, therefore, the end portions may be forcibly lifted from the recesses to permit easy disassembly of the parts of the device.

The actuator is provided with a trackway on its under surface, the trackway comprising a pair of depending integral parallel tabs or ears which are of predetermined length in accordance with the desired travel of the actuator. The casing is provided with an integral centrally disposed upstanding pin which is normally positioned at one end of the trackway, thus establishing desired contact between one set of terminals as is well known. The space between the parallel ears is normally smaller in the transverse direction than the diameter of the pin.

The actuator is slidable on the casing whereupon the pin moves through the space between the ears to a position at the opposite end of the trackway, thus establishling desired contact between second terminals. The ears are flexible and thus the pin can be forcibly moved through the trackway in a desired manner.

BRIEF DESCRIPTION OF THE DRAWINGS

The above and other objectives of this invention will become apparent from the following description taken in connection with the accompanying drawings, wherein:

FIG. 1 is an isometric view of a slide switch embodying the invention;

FIG. 2 is an isometric view of a second type of slide switch embodying the invention;

DESCRIPTION OF THE PREFERRED EMBODIMENTS

Figure 3:
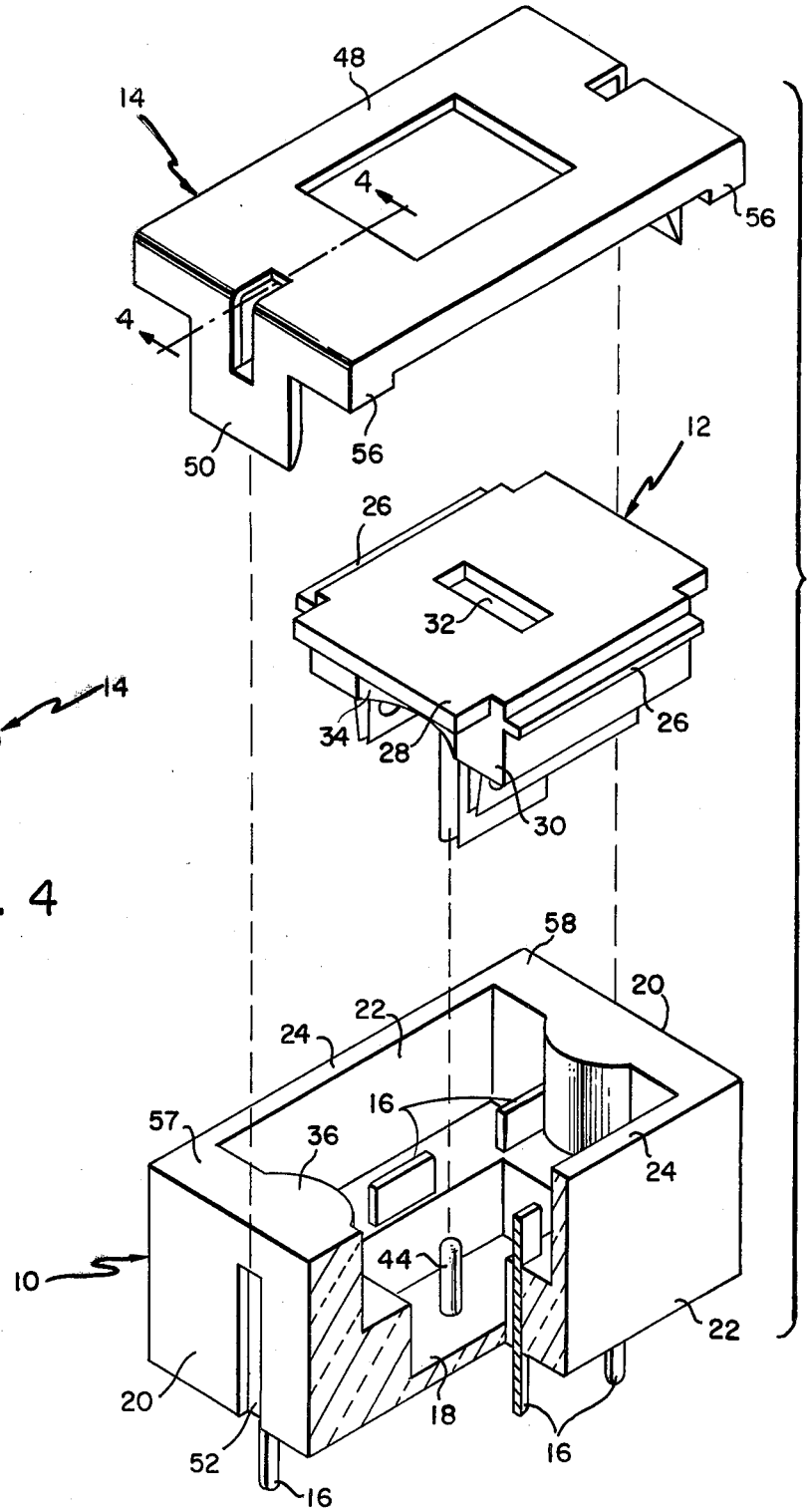
FIG. 3 is an exploded view of the switch of FIG. 1.
Figure 4:
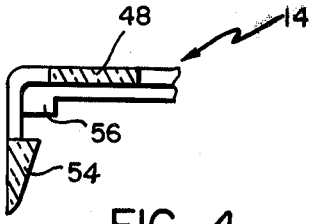
FIG. 4 is a fragmentary vertical sectional view taken substantially on line 4—4 of FIG. 3 looking in the direction of the arrows.

Referring more particularly to the drawings wherein like characters of reference designate like parts throughout the several views, the switch embodying the invention as depicted in FIGS. 1 and 3–7 comprises a molded base or casing 10, an actuator 12, and a closure member, cover or cap 14. The casing 10 is a molded plastic, preferably nylon or other suitable electrically insulating material, and has fixed conductive terminals or leads 16 molded therein at the time the housing is formed.

The casing is a boxlike structure having a base or bottom 18 in which the terminals 16 are fixed, a pair of spaced transverse, parallel end walls 20, and a pair of spaced, longitudinal, parallel side walls 22. The top of the casing is open as shown best in FIG. 3 and the exposed top edges 24 form tracks upon which rest flanged portions 26 which extend along opposite sides of the actuator 12.

The actuator 12 comprises a one-piece molded plastic element including a plate-like upper portion 28 having an integral shaped block 30 on its underside from the sides of which the flanges 26 project. The actuator 12 is provided in its upper surface with a recess 32 by which the actuator may be manually moved by means of the sliding engagement between the flanges 26 and upper end surfaces 24 of casing walls 22. The actuator 12 is permitted limited sliding movement the extent of which is controlled at least in part by the engagement of one or the other of concave end surfaces 34 with integral convex abutments 36 formed on the inner surfaces of the end walls 20 of the casing 10.

Figure 5:
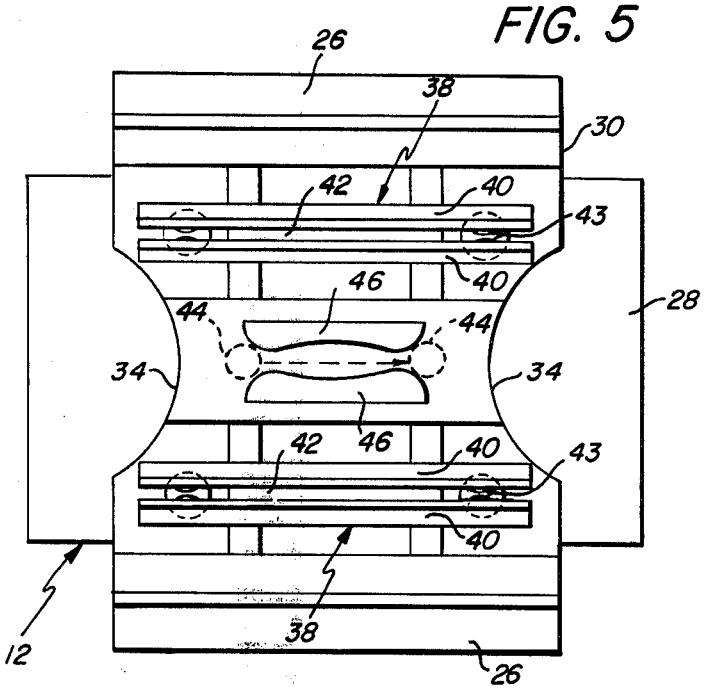
FIG. 5 is a view of the under side of the actuator in the switch of FIG. 1.

A pair of slider elements 38 are fixed in longitudinally extending parallel relation to the under side of the actuator block 30 as shown best in FIG. 5. The slider elements 38 are made from an electrically conducting metal and are each preferably stamped so as to have two opposing elongated spaced blades 40 extending downwardly from a base portion 42 which is suitably seated in a recess in the under side of the actuator block portion 30. Each blade 40 has adjacent its end projecting portions which are essentially embossments 43 projecting inwardly so as to contact opposite sides of the terminals 16 when the slider elements 38 are in a predetermined rest position.

Figure 6:
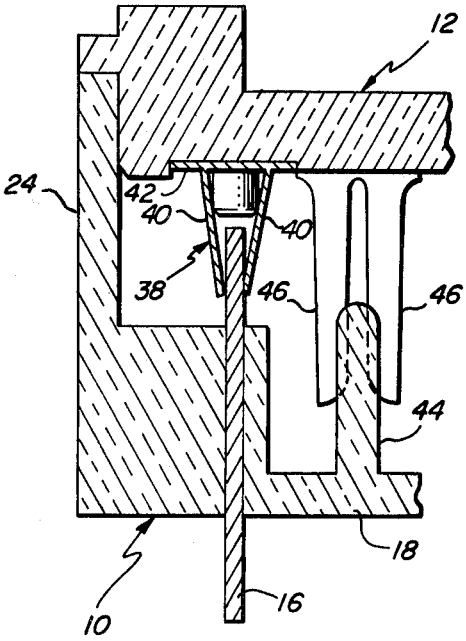
FIG. 6 is a vertical sectional view through a portion of the actuator and casing in the switch of FIG. 1.
Figure 7:
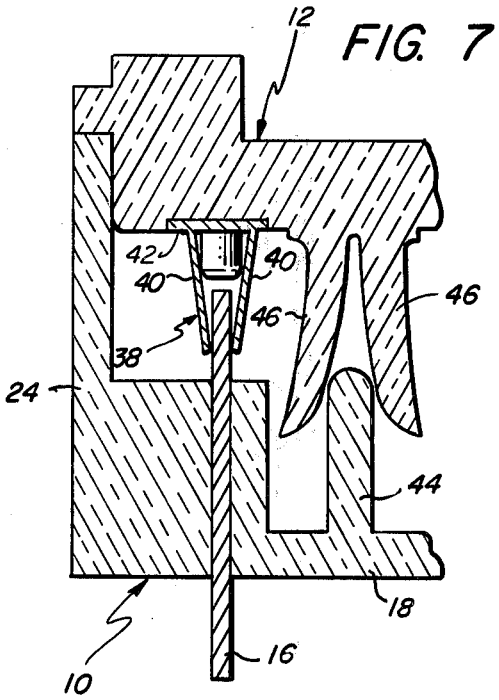
FIG. 7 is a view similar to FIG. 4 showing the trackway expanded by the detent.

There are preferably provided six terminals 16, three on a side, and the inner ends of the terminals are enlarged and project above the bottom 18 into the interior of the casing as seen in FIGS. 3, 6 and 7. the middle terminals are common while the respective pairs of end terminals may be suitably connected to respective circuits. For example, a 120-volt circuit may be connected through the middle terminals and one pair of end terminals, while a 240-volt circuit may be connected through the middle terminals and the other pair of end terminals. Thus the slider elements 38 will continually contact the middle terminals regardless of the position of the actuator, and will contact one or the other of the end pairs of terminals, depending upon the position of the actuator, to complete the selected 120 or 240 volt circuit, as desired.

It is, of course, necessary to provide means for yieldably retaining the actuator 12 in its selected rest position and, in accordance with this invention, this is accomplished by a fixed, rigid upstanding post or pin 44 which is preferably molded integrally with the casing 10 on the inner surface of base 18 thereof, (see FIG. 3). The actuator 12 is provided on its under side with a pair of resilient, depending, parallel tabs or ears 46 which are spaced apart a distance which is substantially less than the diameter of the post 44.

In one rest position of the actuator 12 the post 44 will be disposed adjacent one end of the trackway formed by the ears 46, and in the second rest position the post 44 will be located at the other end of the trackway. It will be seen that when the actuator 12 is moved from one rest position to the other, the post 44 will be forced through the space between the ears 46 as shown by the arrows in FIG. 5. The post 44 is shown in one rest position of the actuator in FIG. 6. However, when the actuator 12 is moved to the second rest position, the post 44 will forcibly spread the ears 46 apart as shown in FIG. 7. Stress on the ears 46 may be partially relieved by making the adjacent inner surfaces of the ears concave as shown in FIG. 5.

From this it will be apparent that the position of the post 44 at either end of the trackway formed by the ears 46 will prevent the actuator 12 from moving until sufficient force is applied to cause the post to overcome the inherent resiliency of the ears.

The cap or cover 14 is removably mounted over the actuator-casing assembly to retain the parts in assembled relation while permitting the actuator to be readily moved. To achieve this the cap 14 has an apertured top portion 48 which covers the assembly and is provided with downturned integral end portions 50 which overlie the end wall 20 of the casing. The end walls 20 are each provided with a recess 52 into which is positioned a fixed dog or catch 54 on the inner sides of the respective end portions 50. The dogs 54 prevent accidental removal of the cap 14 from the assembled actuator and casing. However, because of the inherent flexibility of the material of the cap 14, including the end portions 50, the portions 50 may be lifted to disengage the dogs 54 from the recesses 52, allowing the cap to be removed.

It will be noted that while the underside of the cap 14 is provided with portions 56 which seat directly on the upper exposed surfaces 57 of the end walls 20 of the casing 10, the remainder of the cap 14 is raised slightly above the side wall upper surfaces 24, thus allowing free movement of the flanges 26 upon the surfaces 24.

Figure 8:
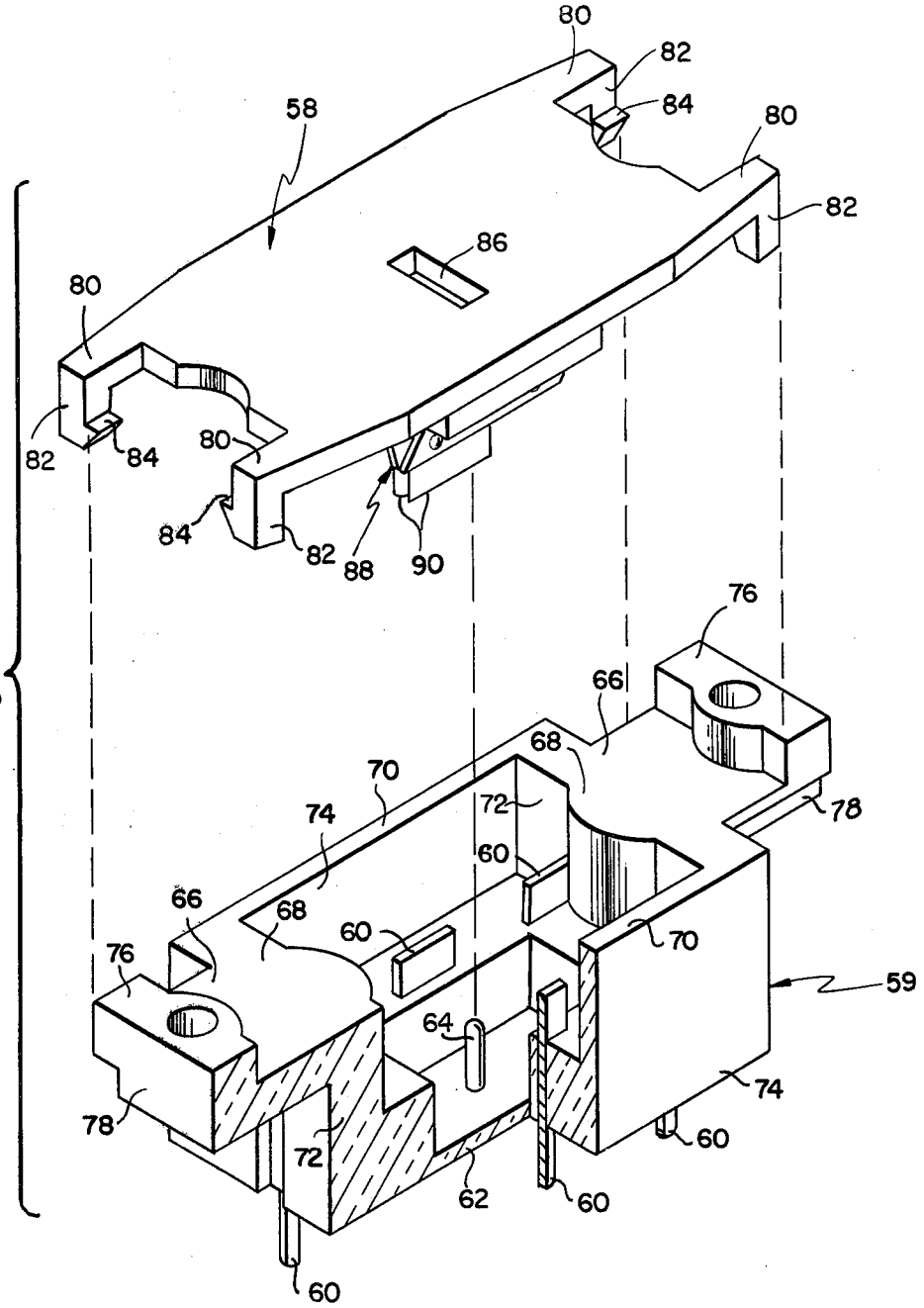
FIG. 8 is an exploded view of the switch of FIG. 2.

Referring now to the embodiment of FIGS. 2 and 8, in this structure the cap 58 also functions as the switch actuator and is removably mounted on the open-topped boxlike casing 59. The casing 59 is generally similar to the casing 24 of FIG. 1, having terminals 60 in its base 62 which project upwardly into the interior of the casing, and having an integral post 64 which is centrally disposed in the base 62.

However, the casing 59 has planar portions 66 extending from each end, the surfaces of which are coplanar with the adjacent surfaces 68 and 70 of the end and side walls 72 and 74 respectively. The extreme outer end of each portion 66 carries an integral barrier 76. The sides of the portions 66 are longitudinally undercut to form tracks 78 upon which the actuator or cap 56 slides, as will be described.

The cap 58 is an essentially flat planar member the under side of which is adapted to slidably repose on the coplanar surfaces 66, 70 and 72 of the casing. Each end of the cap terminates in a pair of longitudinally projecting arms 80 each of which has a downturned end portion 82. The end portions each carry an inwardly directed dog 84 which resides within a respective track 78 on the casing. The top surface of the cap 58 has a recess 86 by which the cap or actuator may be slid lengthwise on the top of the casing. The dogs 84 slidably grip the undersides of the casing portions 66 but allow the cap to slide to the extent permitted by barriers 76, and are resilient to allow easy disengagement so that the cap may be separated from the casing when desired.

The underside of the actuator or cap 58 carries slider elements 88 which contact selected terminals 60 within the casing in the same manner as described in connection with the FIG. 1 embodiment, and also carries flexible ears 90 for yieldable engagement with the post 64 in the casing similar to the structure of FIG. 1.

Thus, it will be seen that in accordance with this invention there has been provided an electrical slide switch having novel means for removably retaining a cap on the switch casing and novel detent means for locating the actuator in a selected rest position.

However, it will be understood that various modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. An electrical slide switch comprising two-piece casing including a base, and an actuator, a plurality of fixed electrically conducting terminals mounted in said base and extending into the interior of said casing, said actuator being slidably mounted on the upper surface of said base, an electrical conductor blade carried by said actuator and movable therewith into contact with selected terminals, yieldable detent means for retaining said actuator in a selected rest position comprising a rigid element carried by said base interiorly of the casing and projecting upwardly toward said actuator, and control means carried by said actuator and in engagement with said element, said base having a boxlike shape with the upper end surfaces of its walls lying in a common plane, said base having mounting means comprising longitudinally protruding end portions extending beyond the end walls thereof, said end portions having upper surfaces lying substantially in the plane of the upper surface of the base, said portions further having upstanding barriers thereon, said upstanding barriers having upper surfaces disposed in the plane of the upper surface of the actuator, and resilient means carried by said actuator for yieldably retaining said actuator in assembled relation with the casing comprising integral end portions on said actuator having means for yieldably interlocking with end portions of said casing.

2. A switch as set forth in claim 1 wherein said protruding end portions have undercut longitudinal edges, and said actuator has downwardly extending resilient end members extending along the sides of said protruding end portions of the base, said members having integral inwardly directed dogs thereon yieldably and slidably engaging said undercut edges of the protruding end portions of the base.

3. An electrical slide switch comprising a casing having a base, a plurality of fixed electrically conducting terminals mounted in said base and extending into the interior of said casing, an actuator slidably mounted on said base, an electrical conductor blade carried by said actuator and movable therewith into contact with selected terminals, resilient means for yieldably retaining said actuator in assembled relation with said casing, yieldable detent means for retaining said actuator in a selected rest position, and a cover having a top disposed over the top of said actuator and casing and having end portions overlying the end walls of the casing, said end walls each having a recess therein, said end portions each having a dog disposed within a respective recess, said end portions being resilient to permit removal of the dogs from the recesses and removal of the cover, and said top of the cover being apertured to expose the upper surface of the actuator, the exposed upper surface of the actuator being provided with recess means for sliding the actuator on the casing beneath the cover.

* * * * *